US008857408B2

(12) United States Patent
Konezny

(10) Patent No.: US 8,857,408 B2
(45) Date of Patent: Oct. 14, 2014

(54) REAL-TIME DYNAMIC HEAVY-VEHICLE IDLE ALARM

(75) Inventor: Ronald E. Konezny, Shorewood, MN (US)

(73) Assignee: Peoplenet Communications Corporation, Minnetonka, MN (US)

( * ) Notice: Subject to any disclaimer, the term of this patent is extended or adjusted under 35 U.S.C. 154(b) by 1233 days.

(21) Appl. No.: 12/750,866

(22) Filed: Mar. 31, 2010

(65) Prior Publication Data

US 2010/0242906 A1 Sep. 30, 2010

Related U.S. Application Data

(60) Provisional application No. 61/165,271, filed on Mar. 31, 2009.

(51) Int. Cl.

| | |
|---|---|
| ***F02D 41/16*** | (2006.01) |
| ***F02N 11/08*** | (2006.01) |
| ***F02D 41/04*** | (2006.01) |
| ***G07C 5/00*** | (2006.01) |
| *F02D 41/08* | (2006.01) |

(52) U.S. Cl.

CPC ..... *F02D 41/042* (2013.01); *F02N 11/0803* (2013.01); *F02N 2200/123* (2013.01); *F02D 2200/701* (2013.01); *G07C 5/008* (2013.01)

USPC ..... 123/339.15

(58) Field of Classification Search

USPC ..... 123/339.15, 339.14, 179.4, 198 D; 701/103, 104, 517, 519, 112, 115, 36, 701/31.4, 2

See application file for complete search history.

(56) References Cited

U.S. PATENT DOCUMENTS

| | | | | |
|---|---|---|---|---|
| 5,619,412 | A * | 4/1997 | Hapka | 701/36 |
| 6,331,825 | B1 | 12/2001 | Ladner et al. | 340/988 |
| 7,558,666 | B2 * | 7/2009 | DiGonis | 701/112 |
| 2002/0033157 | A1 * | 3/2002 | Thompson et al. | 123/179.4 |
| 2007/0203625 | A1 * | 8/2007 | Quigley et al. | 701/33 |
| 2007/0233349 | A1 | 10/2007 | Segal | 701/57 |
| 2007/0288154 | A1 | 12/2007 | Letang | 701/112 |
| 2008/0009988 | A1 | 1/2008 | Metzger | 701/36 |

FOREIGN PATENT DOCUMENTS

KR 2005 0011920 1/2005

OTHER PUBLICATIONS

"Heavy-Duty Vehicle Idling Laws" online article by NYS Department of Environmental Conservation, www.dec.ny.gove/chemical/8585.

(Continued)

*Primary Examiner* — Mahmoud Gimie

(74) *Attorney, Agent, or Firm* — Hollingsworth Davis, LLC

(57) ABSTRACT

A system for managing engine idling operation is provided. The system includes a communication center communicatively coupled to at least one vehicle having an engine. A database is provided that has idling regulation information stored therein based, at least, upon geographic location. The vehicle with the engine further includes an idling detection system. The idling detection system includes an idle detect sensor, a processor and a location information module, such as a GPS receiver. The processor is operably coupled to the idle detect sensor. The location information module is operably coupled to the processor to provide position information relative to the vehicle. The processor is configured to monitor vehicle idling and provide a warning thereof based upon an idling regulation stored in the database selected by current vehicle position information.

49 Claims, 4 Drawing Sheets

(56) References Cited

OTHER PUBLICATIONS

Notification of Transmittal of the International Search Report and the Written Opinion for the international patent application No. PCT/US2010/029381 dated Sep. 17, 2010.

Anonymous: "Compendium of Idling Regulations" [Online] Jan. 2009, XP002590297 American Transportation Research Institute. Retrieved from the Internet: URL:http://www.atri-online.org/research/idling/atri_cabcardl_23_09.pdf.

Office Action dated Jul. 29, 2013 from Canadian Application No. 2746412, 3 pages.

* cited by examiner

REAL-TIME DYNAMIC HEAVY-VEHICLE IDLE ALARM

CROSS-REFERENCE TO RELATED APPLICATION

The present application is based on and claims the benefit of U.S. provisional patent application Ser. No. 61/165,271 filed Mar. 31, 2009, the content of which is hereby incorporated by reference in its entirety.

BACKGROUND

Efforts to control air pollution in modern times have ranged dramatically. Power plants are subject to stringent environmental monitoring and even an individual's automobile now carries extensive pollution control and abatement systems. Heavy vehicles are used by a variety of industries to transfer goods over roadways. Accordingly, such vehicles offer highly-adaptable transport between any two locations connected via a roadway. However, the technology of diesel engines, while generally considered to be more efficient at converting fuel to power, can sometimes be seen emitting visible soot into the air. Accordingly, efforts have been undertaken to attempt to minimize the impact of such diesel engine operation upon the environment. While generally the balance between the utility of the efficient diesel engines and the soot or other pollutants can be accepted when the vehicle is underway, an idling diesel engine invites regulation.

Many states and municipalities have enacted laws or ordinances to specifically address heavy-vehicle diesel engine idling. Often such laws simply prohibit diesel idling for more than a specified period of time, such as five minutes, unless one of a few certain exceptions occur. For example, if a vehicle is stuck in traffic or is idling for maintenance purposes, it may be idling for more than the allotted time. Further, since diesel engines require significant startup in cold weather, the temperature of the air in which the engine is operating may provide an exception. One problem that occurs is that the various different states and municipalities, while common in their desire to regulate diesel engine idling, have generally done so in varied and different ways. For example, the time allowed for such engine idling may be different, and different exceptions may apply depending on, among other things, the jurisdiction within which the engine is operating. Further still, the penalties for violating such a statute or ordinance vary substantially. A few examples are set forth below.

California has a diesel idling ordinance (currently set forth in Title 13, Div. 3, Art. 1, Ch. 10, §2485) that sets a maximum idling time of five minutes. The fine for violating the statute is a minimum of $300. Exemptions are provided for traffic conditions, resting in a sleeper berth beyond 100 feet of residential units, adverse weather conditions or mechanical difficulties, vehicle safety inspection, service or repair, power takeoff involving cargo or work functions, emergency vehicles, preventing safety and/or health emergencies, and queuing beyond 100 feet of a residential area. However, within California, the city of Sacramento has a separate ordinance in Sacramento City Code, Title 8, Ch. 8.116 that further prohibits refrigeration unit operation within 100 feet of residential or school zone unless loading or unloading. Additionally, an exemption is provided by Sacramento to recharge hybrid electric vehicles. Thus, as can be appreciated, even within the state of California, the rules regarding diesel engine idling and operation can vary. Connecticut has a diesel idling ordinance that provides a maximum time of three minutes, and fines that do not exceed $5000 per week. Further, an exemption is provided if, among other things, the temperature is less than 20 degrees Fahrenheit. Similarly, Delaware has an idling statute that sets forth a three minute maximum time and fines ranging from $50 to $500 per offense. The maximum time is increased to fifteen minutes if the temperature is between 32 degrees and −10 degrees Fahrenheit. If the temperature is below −10 degrees Fahrenheit, there is no idling limit. There are various other statutes and ordinances for the District of Columbia; Ga.; Hawaii; Illinois; Maryland; Massachusetts; Minneapolis, Minn.; Owatonna, Minn.; St. Cloud, Minn.; St. Louis, Mo.; Nevada; Clark County, Nev.; Washoe County, Nev.; New Hampshire; New Jersey; New York; Pennsylvania; Philadelphia, Pa.; Rhode Island; Texas; Utah; Salt Lake City, Utah; and Virginia.

These varied and disparate rules and regulations with respect to diesel engine idling present additional difficulties because a given route of a single vehicle traveling from Minneapolis, Minn. to Austin, Tex. may pass through a number of different jurisdictions, each having different idling regulations.

SUMMARY

A system for managing engine idling operation is provided. The system includes a communication center communicatively coupled to at least one vehicle having an engine. A database is provided that has idling regulation information stored therein based, at least, upon geographic location. The vehicle with the engine further includes an idling detection system. The idling detection system includes an idle detect sensor, a processor and a location information module, such as a GPS receiver. The processor is operably coupled to the idle detect sensor. The location information module is operably coupled to the processor to provide position information relative to the vehicle. The processor is configured to monitor vehicle idling and provide a warning thereof based upon an idling regulation stored in the database selected by current vehicle position information.

DETAILED DESCRIPTION OF ILLUSTRATIVE EMBODIMENTS

Embodiments and aspects of the present invention generally include a dynamic real-time heavy-vehicle idle alarm that provides a warning or other suitable information or actions based upon a vehicle idling regulation that is applied based upon real-time positional information of the vehicle.

Figure 1:
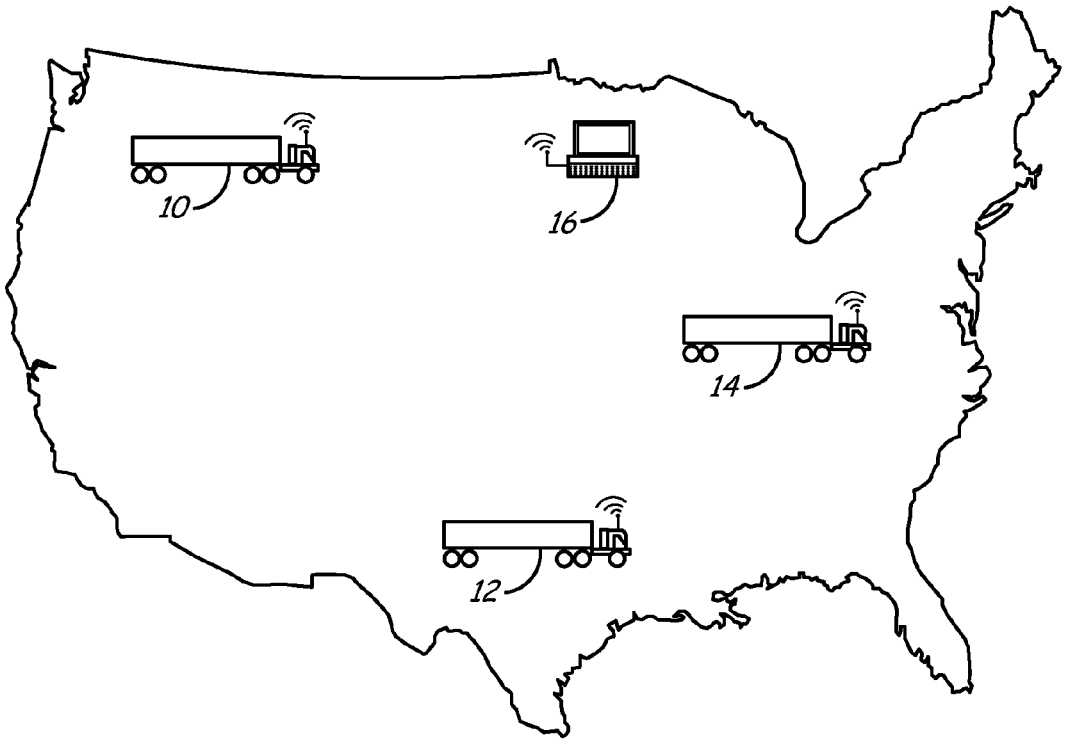
FIG. 1 is a diagrammatic view of a fleet management system with which embodiments of the present invention are particularly applicable.

FIG. 1 is a diagrammatic view of a fleet management system with which embodiments of the present invention are particularly applicable. As illustrated in FIG. 1, a fleet may include heavy vehicles 10, 12, and 14 located in various parts of the country. Each of vehicles 10, 12, and 14 is configured to communicate wirelessly, in one form or another, with a central communication server 16. Fleet management systems, in general, are known. For example, U.S. Pat. No. 6,331,825 provides one exemplary fleet management system. Each of vehicles 10, 12, and 14 employs an internal combustion engine, such as a diesel engine, and may be subject to one or more of the diesel idling regulations set forth above, or other suitable regulations. Preferably, as a given vehicle, such as vehicle 10, sits idling and is in danger of violating its applicable idling regulation, a processor within vehicle 10 or an operator at center 16 can alert the driver or operator to the potential violation. This alert may take the form of an indication (audible, visual, or both) provided via an onboard display, such as on the dashboard of the vehicle or a user interface within the cab of vehicle 10 alerting the driver of the potential violation. However, in some situations, the driver may not be located in the cab and would not see such an indication. Thus, the alert may also be transmitted to the driver's cell phone, in some embodiments. Additionally, the alert can be transmitted to the control center and an operator at control center 16 can use additional communication methods such as calling the driver of vehicle 10 or otherwise communicating with the driver. If no suitable response from the driver is received, additional automatic rules can be employed such that the vehicle itself may shut down or vehicle 10 may receive a command from center 16 to shut down. In any event, the potential violation is identified and the driver of the vehicle, or other responsible party, is messaged or otherwise communicated with to address the threat. While embodiments of the present invention are particularly applicable to the context of a fleet management system operating with a vast fleet of vehicles communicating wirelessly with a central communication center, embodiments of the present invention are also applicable to a simple stand-alone system in a single vehicle.

Figure 2:
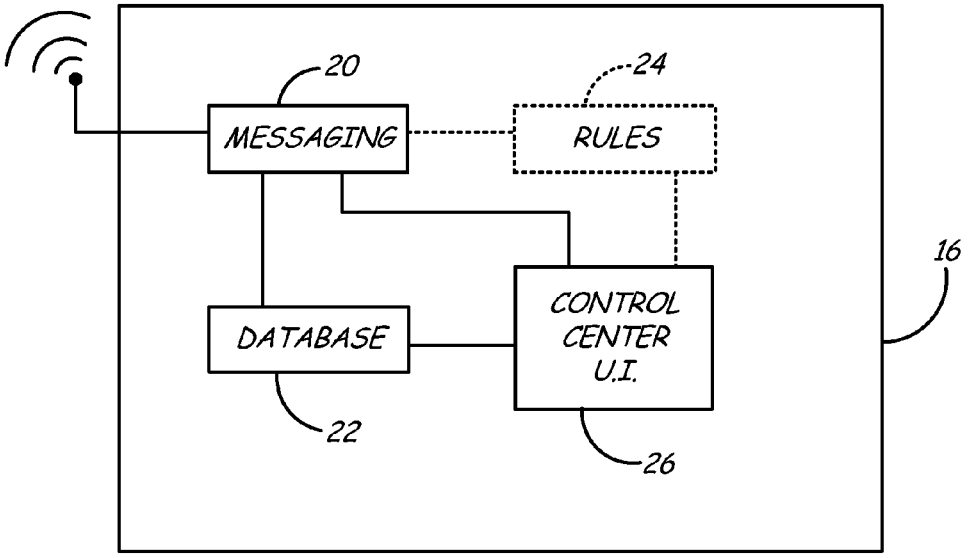
FIG. 2 is a block diagram of a central communication center and a device disposed in a vehicle, in accordance with an embodiment of the present invention.
Figure 2:
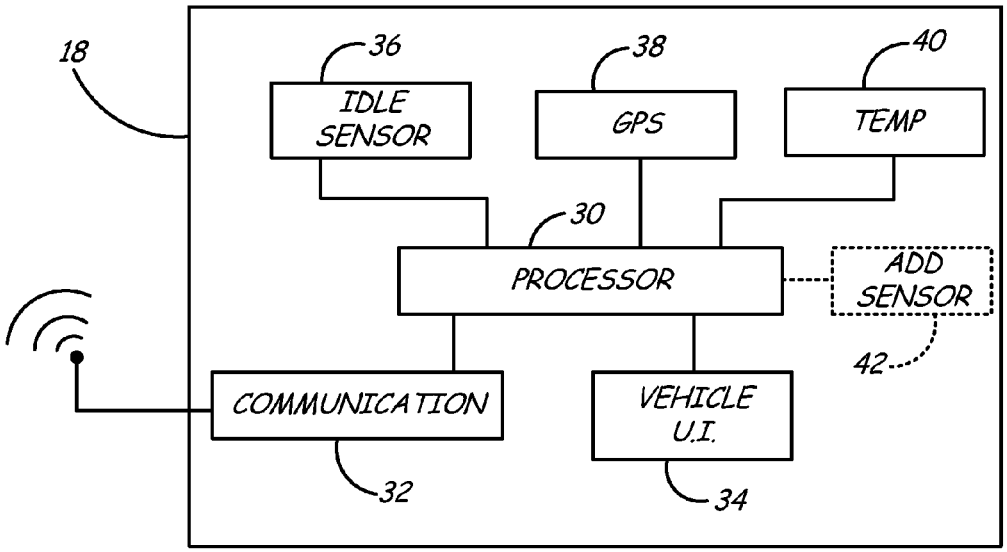

FIG. 2 is a block diagram of a central communication center 16 and a device 18 disposed in a vehicle. As indicated in FIG. 2, control center 16 includes, among other things, a messaging module 20 that is configured to communicate using at least one form of wireless communication. While messaging module 20 is illustrated in FIG. 2 as being coupled to an antenna, messaging module 20 need not be actually coupled to a physical antenna. The antenna is simply provided for clarity of description. In fact, messaging module 20 may be configured to pass electronic messages to another module or third-party service, such as a wireless communication provider (Verizon, Sprint, et cetera), which then transmits a wireless message using any suitable technology to device 18. The message is wireless in the sense that it is wireless as it arrives at device 18. Wireless communication can take the form of cellular communication, such as known CDMA technology, global system for mobile communications (GSM) technology, worldwide interoperability for microwave access (WiMax) technology, or any other suitable technology now known or later developed. Additionally, messaging module 20 may be configured to communicate in accordance with two or more such known technologies. Messaging module 20 is preferably coupled to database 22 that maintains a structured listing of current diesel idling regulations, as well as a machine-readable description of various parameters with respect to each regulation and parameters with respect to one or more exceptions for each regulation. The idling regulation referenced geographical information system (GIS) database 22 can be stored onboard the vehicle, stored at the control center, or any combination thereof. Further, the system can provide a driver input to enter geographical information and/or search for regulation information manually.

As set forth above, the regulations themselves and the exceptions vary substantially. Database 22 allows such information to be maintained conveniently in a central location such that it can be updated easily as laws and regulations change. Center 16 can also include optional rules module 24 that is coupled to messaging module 20. Rules module 24 can include one or more fleet-specific or vehicle-specific rules that can be enforced in addition to, or in place of, default rules or actions that would otherwise execute when a vehicle is in danger of violating an idling regulation. For example, one operator may be willing to risk minor fines with respect to a violation where another operator would simply want his or her vehicle shut down. Further still, such rules can facilitate driver-specific or fleet-specific messaging protocols and/or techniques. Thus, one driver may wish to receive a text message through his/her cell phone while another driver simply wishes to receive a dashboard indication of a potential violation. Rules module 24 facilitates this configurability.

Control center UI 26 is coupled to messaging module 20, database module 22, and optional rules module 24. Control center UI 26 generally is in the form of one or more personal computers through which a human operator can view messages and other data from individual vehicles as well as corresponding database information and/or rules. The operator can then communicate with one or more operators of the vehicles or take other suitable action as may be appropriate. The control center's ability to monitor and/or communicate with a plurality of vehicles and/or groups of vehicles facilitates a number of useful functions. For example, an operator at the control center can analyze information received from the vehicles (either real-time or historical) and provide reports based on the analysis. Further, these reports can be provided, such as via a web server, to owners, operators and/or interested parties. The control center can provide the alerts and/or reports to drivers, dispatchers, and/or any relevant party in the entire supply chain shipper/receiver). The alerts can be sent via email to any suitable address, including addresses of mobile phones of any suitable person. Further still, the alerts and/or reports may be sent via the SMS message system (i.e. text message).

Module 18 resides in each vehicle monitored in accordance with embodiments of the present invention. Module 18 is preferably powered by the power system of the vehicle and includes a processor, such as a microprocessor, 30. Processor 30 is coupled to communication module 32 which is configured to cooperatively communicate with messaging module 20 of central communication center 16. Accordingly, communication module 32 can include one or more of the various technologies listed above with respect to messaging module 20. Processor 30 is also operably coupled to a in-cab user interface 34. User interface 34 may simply be an LCD screen and one or more buttons to allow an operator to confirm or cancel various commands and messages. However, user interface 34 can also comprise an entire touch-screen interface operably coupled to processor 30. Moreover, user interface 34 also includes suitable software to interact with the touch screen to provide various data and/or interactions with the user.

Processor 30 is operably coupled to idle sensor 36 in accordance with an embodiment of the present invention. Sensor 36 can be any suitable hardware, software, or combination thereof that is able to detect a vehicle idle state. In one embodiment, idle sensor 36 is simply coupled to, or otherwise employs, a vehicle speed sensor. Thus, when the vehicle is operating but not moving, it is considered to be idling. In another embodiment, idle sensor 36 is coupled to an engine RPM sensor to detect idling when RPM is below a selected threshold. In another embodiment, idle sensor 36 uses information from a position information module 38 (illustrated diagrammatically as a GPS module) to determine whether the vehicle is undergoing suitable motion while the ignition is on. In another embodiment, idle sensor 36 can be coupled to an interface of an engine control module (ECM) to receive a signal or other information from the ECM that is indicative of an engine idle state. In still another embodiment, idle sensor 36 may be coupled to a wheel sensor to sense wheel motion such that idling may be indicated when the wheel is not moving and the ignition is on. At least some embodiments of the present invention include an idle sensor 36 formed of a suitable computer program executing upon processor 30 reviewing or otherwise calculating vehicle movement based upon vehicle position information. However, embodiments of the present invention can include each or all of the sensors described above as well as combinations thereof.

Certain exceptions to diesel idling regulations are based upon temperature of ambient air. Thus, vehicle module 18 preferably includes temperature sensor 40 operably coupled to processor 30 to provide an indication of ambient air temperature. Temperature sensor 40 can take the form of any suitable temperature sensor technology such as a resistance temperature device (RTD), a thermocouple, a thermistor, or any other suitable device. Further still, embodiments of the present invention may employ data communication through module 32 to communicate with a server having real-time temperature information related to location. Thus, module 18 could provide the relative vehicle position (based upon information from GPS module 38) through communication module 32 to receive the current air temperature as sensed at some suitable nearby location. Thus, in some embodiments, temperature sensor 40 may be embodied by programming instructions executing upon the processor 30 using position information from GPS module 38 and communicating with external server through communication interface 32.

Vehicle module 18 can also include one or more additional sensors 42 to sense any suitable parameter that may be related to the applicability to the idling regulation or one or more exceptions. For example, an additional sensor 42 can be a sensor that determines whether a refrigeration unit is being operated.

Figure 3:
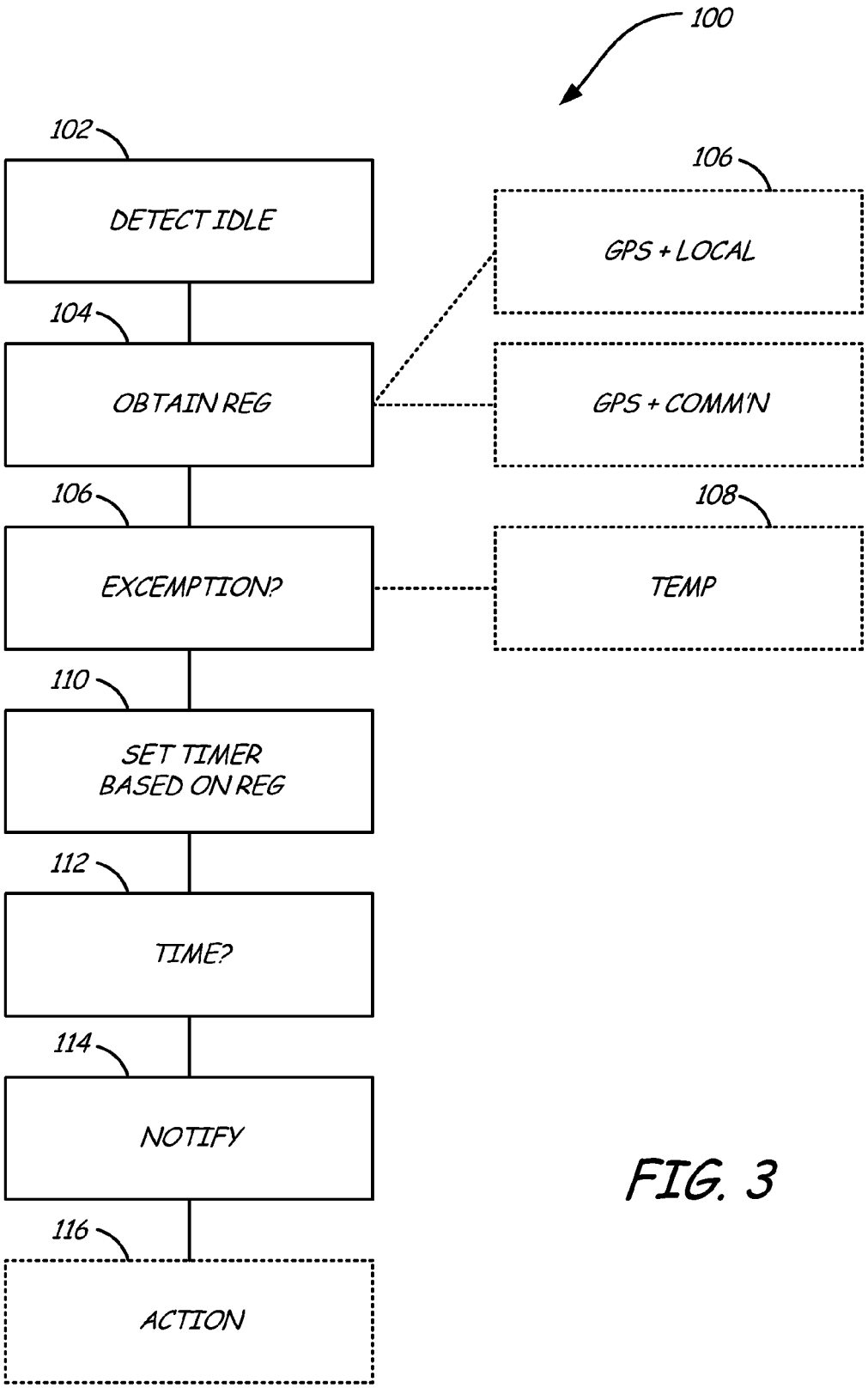
FIG. 3 is a diagrammatic view of a method of identifying and reacting to a diesel idling condition in accordance with an embodiment of the present invention.

FIG. 3 is a diagrammatic view of a method of identifying and reacting to a diesel idling condition in accordance with an embodiment of the present invention. Method 100 begins at block 102 when system 18 detects that the vehicle is idling. Detection at block 102 is preferably a low-level detection such as determining that the vehicle is running, but has not moved for ten or twenty seconds. The threshold is preferred to be low enough that it is shorter than all idling statutes and regulations, but is long enough that the method does not execute for each and every time the vehicle comes to a stop sign or otherwise pauses momentarily. Upon detection of idling in block 102, system 18 obtains regulation information as indicated at block 104. In one embodiment, this involves block 106 where GPS information from GPS module 38 is used to query a local database stored within the module 18 (this embodiment will be described further with respect to FIG. 4). In another embodiment, regulation information can be obtained by passing GPS information from module 38 through communication module 32 to central communication center 16 to receive relevant regulation information from center 16. Such communication can be via a wireless wide area network (WWAN) such as those employing WiMax or GSM communication, for example. Regardless, once the regulation information has been obtained, block 106 executes to determine if an idling exception applies. For example, temperature information from temperature sensor 40 can be obtained to determine if the air temperature around the vehicle is low enough for an extended idling period to apply or an infinite idling period to apply, as indicated at block 108. Assuming that the regulation applies, block 110 executes where a timer is set that, once elapsed from the initial idle detection of block 102, will generate a notification. Thus, block 112 determines if the timer set in block 110 has elapsed. Once sufficient time has passed, block 114 executes and the driver and/or communication center is appropriately notified. Next, at optional block 116, one or more suitable actions can occur relative to the idling vehicle. Such actions can involve the driver ignoring the alarm, the driver acknowledging the alarm, the driver choosing to move the vehicle, or the driver choosing to shut the vehicle down.

Figure 4:
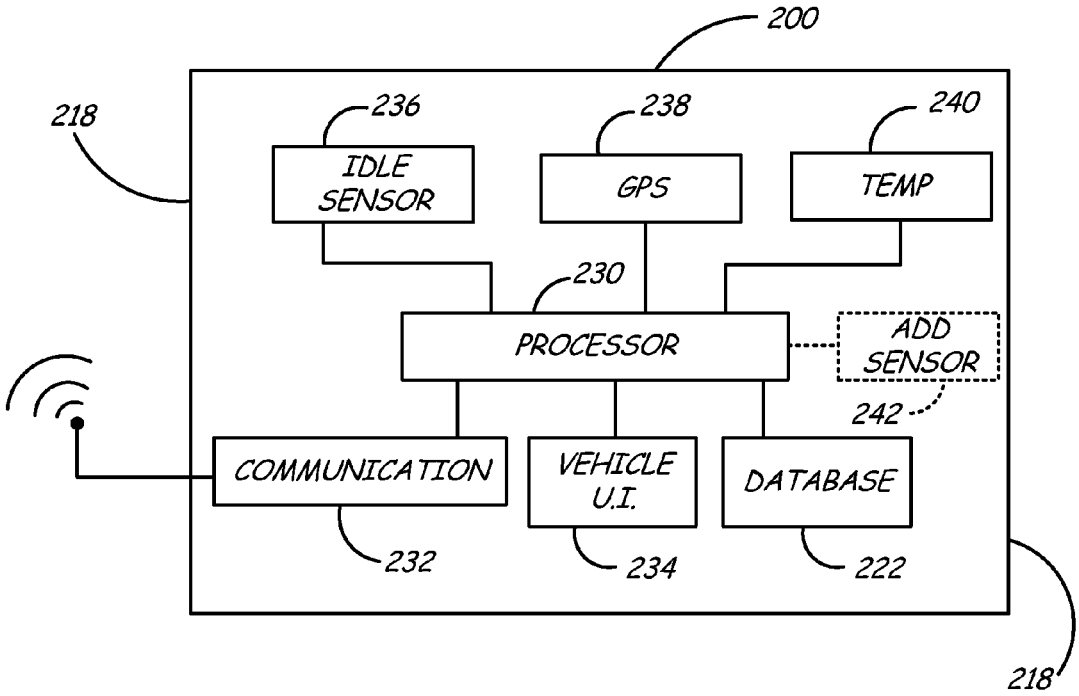
FIG. 4 is a block diagram of an on-board dynamic real-time vehicle idling detection warning system in accordance with an embodiment of the present invention.

FIG. 4 is a block diagram of an on-board dynamic real-time vehicle idling detection and warning system in accordance with an embodiment of the present invention. System 200 bears many similarities to system 18 and like components are numbered similarly. Thus, system 200 includes idle sensor 236 that may be similar or identical to idle sensor 36 described above. Additionally, processor 230 of system 200 is operably coupled to GPS module 238, temperature sensor 240, and additional sensor(s) 242. Further, system 200 includes a vehicle user interface 234 that can be similar or identical to vehicle user interface 34 described above. System 200 differs from system 18 in two important regards. First, communication interface 232 of system 200 can include a wired communication interface, such as a serial interface, USB interface, compact flash interface, or other suitable interface through which data can be loaded into system 200. Additionally, system 200 includes local database 222 that contains all of the information set forth above with respect to database 22. Thus, a user of a vehicle can load regulation information into system 200 through communication interface 232 and such information can be stored in database 222. Additionally, or alternatively, database updates and/or changes can be sent to the vehicle using suitable over-the-air-programming (OTAP) techniques. By maintaining a local database, as method 100 executes in various locations, the communication overhead is reduced since each vehicle is not requesting information regarding the regulations. Instead, only information regarding potential and/or actual idling regulation violations can be communicated between the vehicle and communication center 16. Further still, system 200 can communicate directly with the driver through user interface 234 to alert the driver that a potential violation is occurring. If the driver does not respond within a selected amount of time, either by acknowledging or otherwise actively ignoring the warning, then system 200 can communicate with communication center 16 in order to receive further actions, such as notifying another responsible party or otherwise shutting down the vehicle.

Accordingly, embodiments of the present invention generally allow operators of individual vehicles as well as entities that operate entire fleets to monitor and manage vehicle operation in order to comply with the various idling regulations currently in force through various geographical jurisdictions. Further still, while embodiments of the present invention have generally been described with respect to the applicability of a regulation based upon the geographic position of the vehicle and the potential applicability of one or more exceptions based upon temperature, it is expressly contemplated that additional applicability and/or exception conditions can be applied based upon other suitable parameters such as time of day, day of week, model of diesel engine, blend of fuel, operating condition of the vehicle, maintenance factors, or other suitable parameters.

Although the present invention has been described with reference to preferred embodiments, workers skilled in the art will recognize that changes may be made in form and detail without departing from the spirit and scope of the invention.

What is claimed is:

1. A system for managing internal combustion engine idling operation and communicating with a remote communication center, the system comprising:

a database having idling regulation information stored therein based, at least in part, upon geographic location; and a vehicle having the internal combustion engine and further comprising an idling detection system including:

an idle detect sensor;

a processor operably coupled to the idle detect sensor; and a position information module operably coupled to the processor to provide vehicle position information; and wherein the processor is configured to:

monitor vehicle idling;

detect an actual violation of an idling regulation stored in the database selected by vehicle position;

detect a potential violation that the vehicle is in danger of violating an idling regulation stored in the database selected by vehicle position;

provide a warning of the actual violation; and provide a warning of the potential violation.

2. The system of claim 1 and further comprising wireless communication circuitry disposed within the vehicle and operably coupled to the processor to communicate with the communication center.

3. The system of claim 2, wherein the database is stored in an onboard system within the vehicle.

4. The system of claim 3, wherein the database is updateable via the over-the-air programming (OTAP).

5. The system of claim 2, wherein the regulation information includes applicability conditions based upon a plurality of factors, a first factor being a location.

6. The system of claim 1, wherein the internal combustion engine is a diesel engine.

7. The system of claim 1, wherein the warning includes an alert to an operator of the vehicle indicative of a potential idling regulation violation.

8. The system of claim 1, wherein the processor is further configured to shut the engine down if no response to the warning is received.

9. The system of claim 1, wherein the idle detect sensor includes an RPM sensor and speed sensor.

10. The system of claim 1, wherein the warning includes an alert to an operator of the vehicle using an onboard display on the vehicle.

11. The system of claim 1, wherein the warning includes an alert to an operator of the vehicle, the alert presented using a cellular phone of the operator.

12. A method of identifying and reacting to an engine idling condition of an internal combustion engine in a vehicle, the method comprising:

detecting a vehicle idling condition;

obtaining location information upon detection of the vehicle idling condition, and using the location information to retrieve relevant regulation information;

initiating a timer based upon the retrieved regulation information; and upon expiration of the timer, providing a notification relative to the engine idling state, the notification indicative of a potential idling regulation violation that the vehicle is in danger of violating the idling regulation based on the location information, the notification including an alert to at least one of an operator of the vehicle and a central communication center in communication with the vehicle indicative of the potential idling regulation violation.

13. The method of claim 12, wherein the engine is a diesel engine.

14. The method of claim 12, wherein the notification includes an alert to an operator of the vehicle indicative of a potential idling regulation violation.

15. The method of claim 12, and further comprising shutting the engine down if no response to the notification is received.

16. The method of claim 12, wherein detecting a vehicle idling condition includes sensing an engine RPM value and a vehicle speed value.

17. An engine monitoring system for a vehicle, the system comprising:

an engine idling sensor;

a vehicle position sensor;

a processor operably coupled to the idling sensor and the vehicle position sensor;

an idling regulation database providing regulation information based, at least in part, on geographic location, the database being physically stored within the vehicle and being operably coupled to the processor; and wherein the processor is configured to:

detect an engine idle condition using the engine idling sensor;

detect an actual violation of an idling regulation stored in the idling regulation database selected by vehicle position information provided to the processor by the vehicle position sensor;

detect a potential violation that the vehicle is in danger of violating an idling regulation stored in the idling regulation database selected by vehicle position information provided to the processor by the vehicle position sensor;

provide a warning of the actual violation; and provide a warning of the potential violation.

18. The system of claim 17 and further comprising wireless communication circuitry disposed within the vehicle and operably coupled to the processor to communicate with a communication center.

19. The system of claim 18, wherein the database is updateable via the over-the-air programming (OTAP).

20. The system of claim 17, and further comprising a wired communication interface to facilitate uploading information into the idling regulation database.

21. The system of claim 17, and further comprising at least one additional sensor operably coupled to the processor.

22. The system of claim 21, wherein the at least one additional sensor provides a sensor reading that is related to exception information stored in the database.

23. The system of claim 22, wherein the sensor is an ambient air temperature sensor.

24. The system of claim 17, wherein the regulation information includes applicability conditions based upon a plurality of factors, a first factor being a location.

25. The system of claim 24, wherein a second factor includes a time of day.

26. The system of claim 24, wherein a second factor includes a day of the week.

27. The system of claim 24, wherein a second factor includes a model of the engine.

28. The system of claim 24, wherein a second factor includes a blend of fuel used by the engine.

29. The system of claim 24, wherein a second factor includes an operating condition of the engine.

30. The system of claim 17 and further comprising a rules module that includes at least one fleet-specific rule that can be enforced in addition to a default rule or action that would otherwise execute when the vehicle is in danger of violating an idling regulation.

31. The system of claim 30, wherein the rules module provides fleet-specific messaging.

32. The system of claim 17, wherein the internal combustion engine is a diesel engine.

33. The system of claim 17, wherein the warning includes an alert to an operator of the vehicle indicative of a potential idling regulation violation.

34. The system of claim 17, wherein the processor is further configured to shut the engine down if no response to the warning is received.

35. The system of claim 17, wherein the idle detect sensor includes an RPM sensor and speed sensor.

36. A method of operating a control center to manage engine idling conditions of a plurality of internal combustion engines, the method comprising:

receiving an indication of an engine idling state of a vehicle having one of the internal combustion engines;

obtaining position information relative to the vehicle;

obtaining idling regulation information based upon the position information;

providing the idling regulation information;

monitoring vehicle idling;

detecting an actual violation of an idling regulation based on the position information and the idling regulation information;

detecting a potential violation that the vehicle is in danger of violating an idling regulation based on the position information and the idling regulation information;

providing a warning of the actual violation; and providing a warning of the potential violation.

37. The method of claim 36, wherein at least one of receiving the indication of an engine idling state and providing the idling regulation information includes communicating wirelessly between the control center and the vehicle.

38. The method of claim 36, and further comprising receiving information relative to at least one additional sensor in the vehicle.

39. The method of claim 38, wherein the information relative to at least one additional sensor is related to exception information stored in an idling regulation database.

40. The method of claim 39 wherein the idling information database is stored at the command center.

41. The method of claim 38, wherein the information relative to at least one additional sensor is ambient air temperature.

42. The method of claim 36, wherein the regulation information includes applicability conditions based upon a plurality of factors, a first factor being a vehicle location.

43. The method of claim 42, wherein a second factor includes a time of day.

44. The method of claim 42, wherein a second factor includes a day of the week.

45. The method of claim 42, wherein a second factor includes a model of the one of the internal combustion engines.

46. The method of claim 40, wherein a second factor includes a blend of fuel used by the one of the internal combustion engines.

47. The method of claim 42, wherein a second factor includes an operating condition of the one of the internal combustion engines.

48. The method of claim 42, and further comprising providing an alert to an operator of the vehicle indicative of a potential idling regulation violation.

49. The method of claim 36, and further comprising shutting the one of the internal combustion engines down based upon the idling regulation information.

* * * * *